US007575445B2

(12) United States Patent
Kolivoski et al.

(10) Patent No.: US 7,575,445 B2
(45) Date of Patent: Aug. 18, 2009

(54) CONTACT PROTECTOR

(75) Inventors: Christopher J. Kolivoski, York, PA (US); Stuart C. Stoner, Lewisberry, PA (US); Michael V. Strawser, Lewisberry, PA (US); Joseph B Shuey, Camp Hill, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/677,413

(22) Filed: Feb. 21, 2007

(65) Prior Publication Data

US 2008/0200051 A1 Aug. 21, 2008

(51) Int. Cl.
*H01R 12/00* (2006.01)

(52) U.S. Cl. ..... 439/79

(58) Field of Classification Search ..... 439/79, 439/148, 630, 299, 135, 136, 345, 150, 940; 361/737

See application file for complete search history.

(56) References Cited

U.S. PATENT DOCUMENTS

| | | | | |
|---|---|---|---|---|
| 2,932,811 | A | 4/1960 | Abraham et al. | |
| 4,125,313 | A | 11/1978 | Sipp et al. | |
| 4,396,245 | A | 8/1983 | Lane | |
| 4,641,908 | A | 2/1987 | Steffinger | |
| 5,026,295 | A | 6/1991 | Fong et al. | |
| 5,213,514 | A | 5/1993 | Arai | |
| 5,219,295 | A | 6/1993 | Niwa et al. | |
| 5,387,123 | A | 2/1995 | Puerner | |
| 5,601,444 | A * | 2/1997 | Cox | 439/299 |
| 5,681,174 | A | 10/1997 | Correll, Jr. et al. | |
| 5,722,861 | A | 3/1998 | Wetter | |
| 5,924,876 | A | 7/1999 | Beamenderfer et al. | |
| 5,931,687 | A | 8/1999 | McFarlane et al. | 439/79 |
| 6,139,336 | A | 10/2000 | Olson | |
| 6,144,563 | A * | 11/2000 | Feldman et al. | 361/829 |
| 6,200,171 | B1 | 3/2001 | Fusselman et al. | |
| 6,210,218 | B1 | 4/2001 | Chang | 439/567 |
| 6,219,913 | B1 | 4/2001 | Uchiyama | 29/883 |
| 6,269,005 | B1 * | 7/2001 | Tung et al. | 361/737 |
| 6,350,134 | B1 | 2/2002 | Fogg et al. | 439/79 |
| 6,402,552 | B1 | 6/2002 | Wagner | 439/606 |

(Continued)

FOREIGN PATENT DOCUMENTS

WO WO 2007076901 A1 7/2007

OTHER PUBLICATIONS

In the United States Patent and Trademark Office, Non-Final Office Action in re:.U.S. Appl. No:. 11/677,449 filed Feb. 21, 2007, Dated Sep. 12, 2007, 15 pages.

(Continued)

*Primary Examiner*—Edwin A. Leon
(74) *Attorney, Agent, or Firm*—Woodcock Washburn LLP

(57) ABSTRACT

The invention provides a connector that incorporates an insert that may protect the contacts of a card slot. The insert may also double as a structural member so that the opening of the card slot does not deform. The insert may be a device that engages the card slot of an edge card. In one embodiment, the insert may include a wall stop, a grip, and a protective member. The grip may extend from a back side of the wall stop and the protective member may extend from a front side of the wall stop.

30 Claims, 19 Drawing Sheets

U.S. PATENT DOCUMENTS

| | | | | |
|---|---|---|---|---|
| 6,505,402 | B2 | 1/2003 | Moriwake et al. | 29/883 |
| 6,506,064 | B1 | 1/2003 | Wu | |
| 6,685,486 | B1 | 2/2004 | Zhang et al. | 439/79 |
| 6,736,676 | B2 | 5/2004 | Zhang et al. | 439/607 |
| 7,083,441 | B1 * | 8/2006 | Lee | 439/148 |
| 7,175,446 | B2 | 2/2007 | Bright et al. | |
| 7,204,699 | B2 | 4/2007 | Stoner et al. | |
| 7,214,104 | B2 | 5/2007 | Minich et al. | |
| 7,258,551 | B2 | 8/2007 | Minich | |
| 7,384,289 | B2 | 6/2008 | Minich | |
| 2006/0068620 | A1 | 3/2006 | Okamura et al. | 439/79 |
| 2006/0134952 | A1 | 6/2006 | Meister et al. | 439/148 |
| 2006/0216969 | A1 | 9/2006 | Bright et al. | 439/79 |
| 2006/0223343 | A1 | 10/2006 | Campini et al. | 439/64 |

OTHER PUBLICATIONS

In the United States Patent and Trademark Office, Non-Final Office Action in re:.U.S. Appl. No:. 11/677,449 filed Feb. 21, 2007, Dated Feb. 11, 2008, 9 pages.

In the United States Patent and Trademark Office, Final Office Action in re:.U.S. Appl. No:. 11/677,449 filed Feb. 21, 2007, Dated Jul. 11, 2008, 11 pages.

In the United States Patent and Trademark Office, Notice of Allowance and Fee(s) Due in re:.U.S. Appl. No:. 11/677,449 filed Feb. 21, 2007, Dated Oct. 31, 2008, 9 pages.

* cited by examiner

CONTACT PROTECTOR

CROSS REFERENCE TO RELATED APPLICATIONS

This application is related to application Ser. No. 11/677,449 filed Feb. 21, 2007.

FIELD OF THE INVENTION

The invention relates generally to electrical connectors. More particularly, the invention relates to connectors having card slots.

BACKGROUND OF THE INVENTION

Advanced Mezzanine Cards are printed circuit boards (PCBs) that follow a specification of the PCI Industrial Computers Manufacturers Group (PICMG). PICMG AMC connectors may be used in such a specification. There are problems, however, with the card slots of the connectors when pressing the connectors onto the PCB's. For example, the openings of the card slots may deform or dirt and debris may enter the card opening.

SUMMARY OF THE INVENTION

The invention provides a connector that incorporates an insert that may protect the contacts of a card slot. The insert may also double as a structural member so that the opening of the card slot does not deform. The insert may be a device that engages the card slot of an edge card.

In one embodiment, the insert may include a wall stop, a grip, and a protective member. The grip may extend from a back side of the wall stop and the protective member may extend from a front side of the wall stop. The insert may be inserted into the card slot of an edge card housing.

DETAILED DESCRIPTION OF ILLUSTRATIVE EMBODIMENTS

Figure 1:
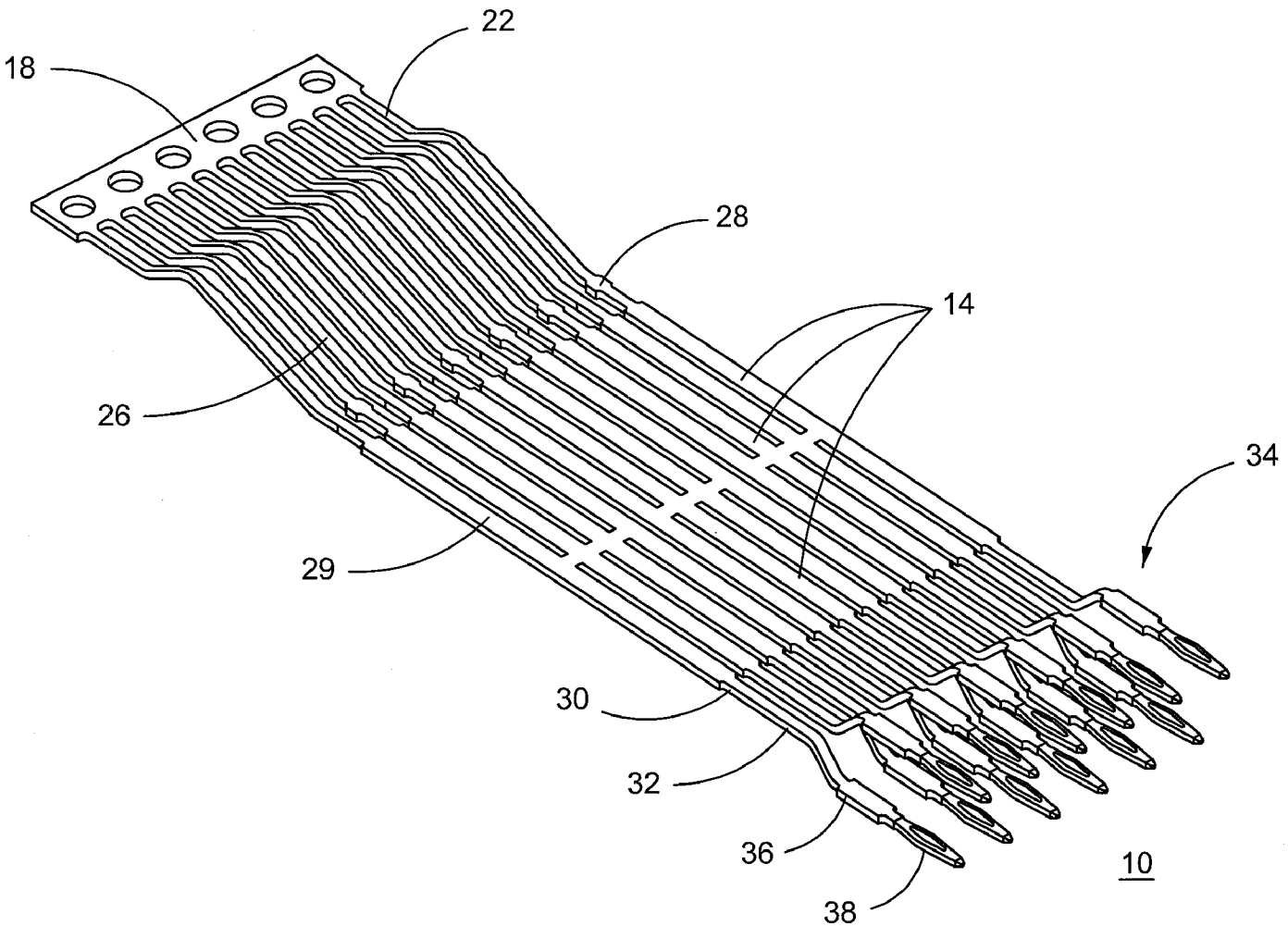
FIG. 1 depicts an isometric view of an embodiment of a first leadframe of electrical contacts as stamped and plated.

A first embodiment leadframe 10 of electrical contacts 14 may be stamped from a sheet of electrically conductive material, such as copper alloy, for example. FIG. 1 depicts the first leadframe 10 of electrical contacts 14 attached to one another and to a carrier frame 18. Each contact 14 may include a mating end 22, a mating portion 26, a first housing portion 28, a lead portion 29, a second housing portion 30, a third housing portion 32, a mounting portion 34, and a mounting end 36. The lead portions 29 of the contacts may be attached to one another via "bridges" that remain after stamping. The mounting ends 36 of the contacts may each include a tail 38. The contacts 14 may be selectively gold plated.

Once the leadframe 10 has been stamped, a first leadframe housing 42 may be overmolded onto the first housing portions 28 of the contacts 14. A second leadframe housing 46 may be overmolded onto the second housing portions 30 of the contacts. Each leadframe housing may be made of a dielectric material, such as a plastic. Both housings may be overmolded onto the leadframe 10 in a single molding process using well-known techniques.

Figure 2:
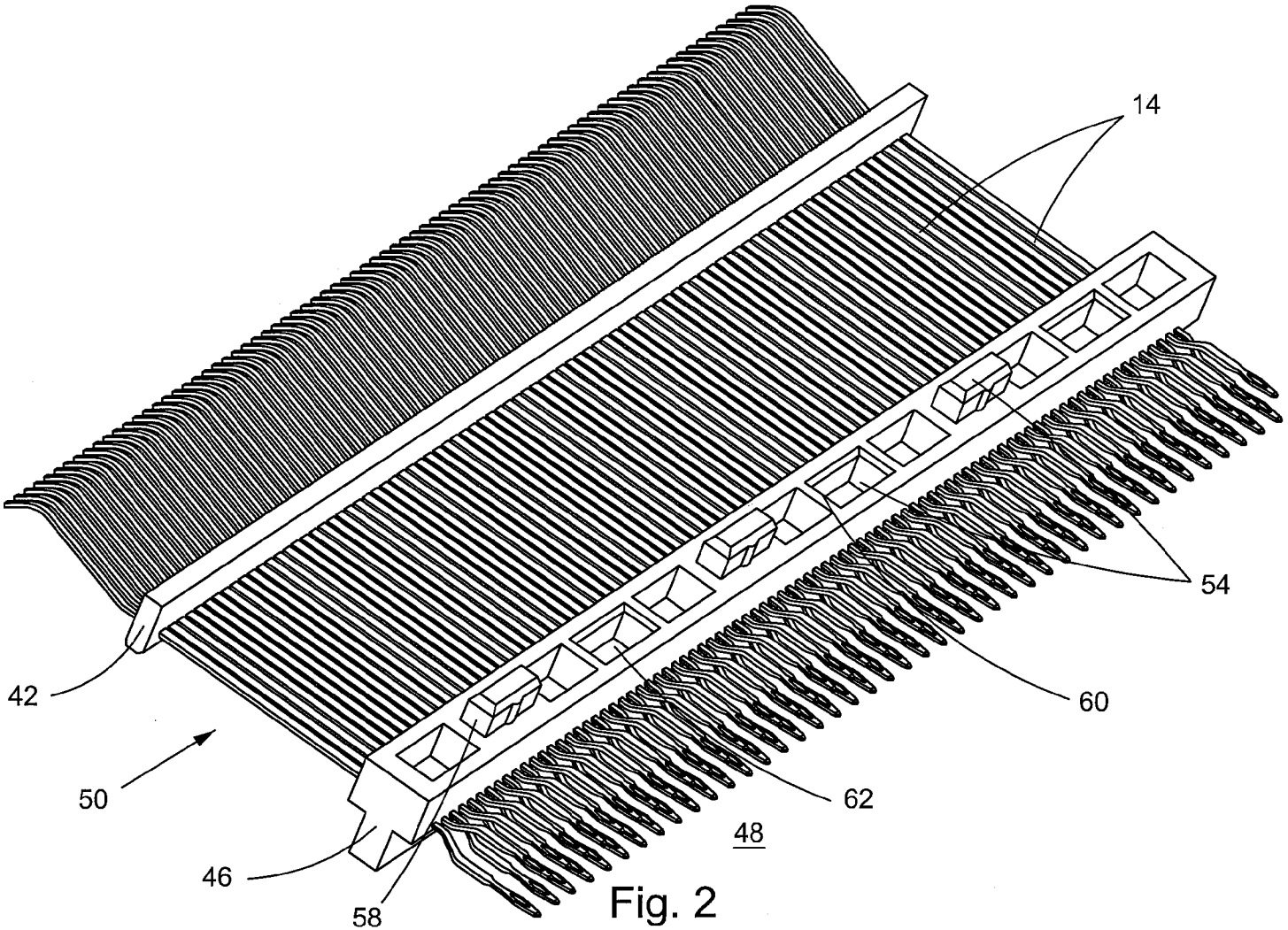
FIG. 2 depicts an isometric view of a first leadframe assembly after molding.

FIG. 2 depicts a first leadframe assembly 48 after the first leadframe housing 42 and the second leadframe housing 46 have been overmolded onto the electrical contacts 14, with the carrier frame 18 shown in FIG. 1 removed. As shown, a linear array 50, or "row," of electrical contacts 14 may extend through each of the first leadframe housing 42 and the second leadframe housings 46.

The second housing 46 may include one or more interlock members 54. As shown, each interlock member 54 may be a protrusion 58 that extends from a face 60 of the housing 46, or a recess 62 defined by the leadframe housing 46. Each recess 62 is adapted to receive a complementary protrusion extending from a leadframe housing of a second leadframe assembly, and each protrusion 58 is adapted to be received in a complementary recess defined by a leadframe housing of a second leadframe assembly. The interlock members 54 will be described in more detail in connection with FIG. 8.

Figure 3:
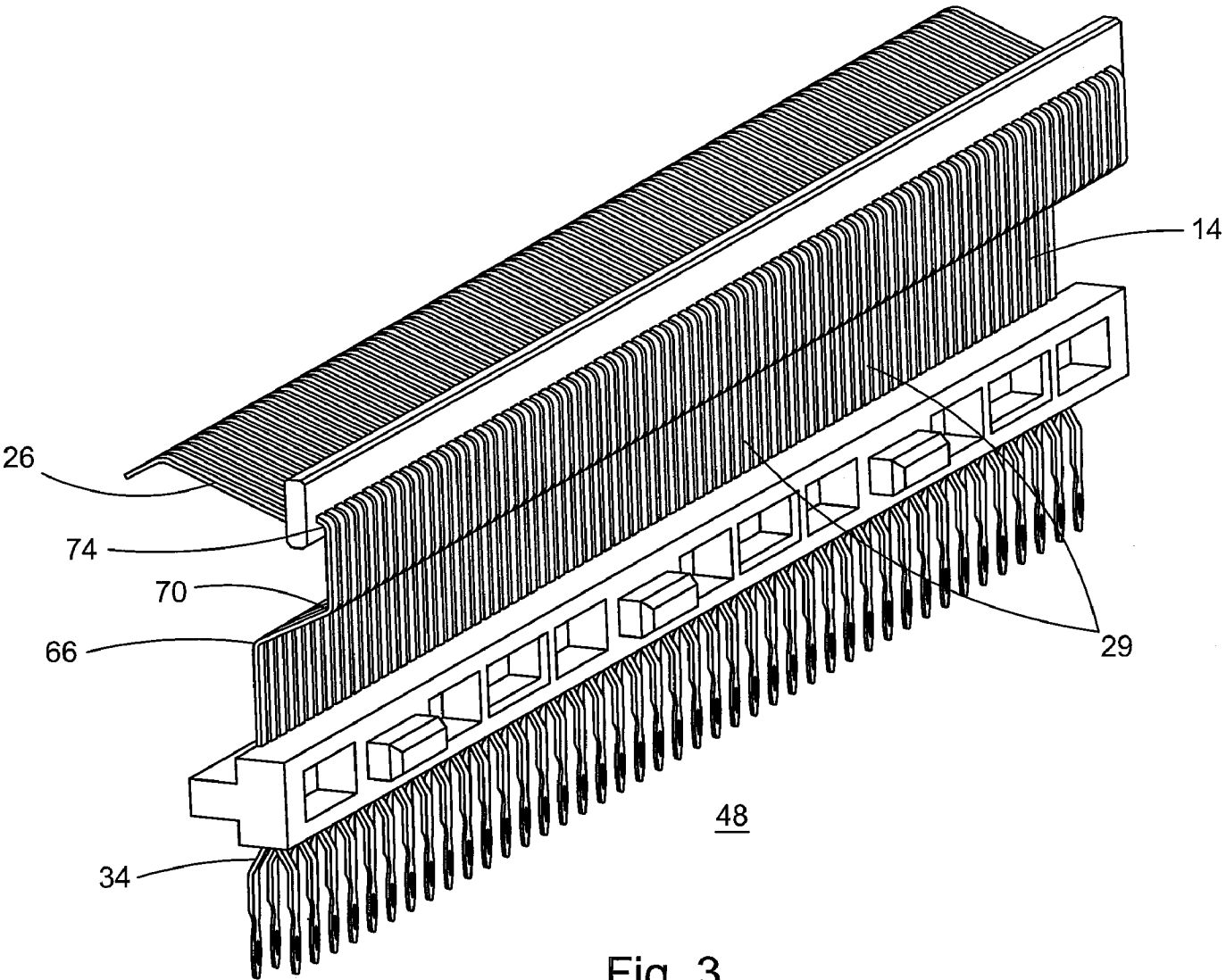
FIG. 3 depicts an isometric view of the first leadframe assembly of FIG. 2 after forming and slug out.

After the leadframe housings are overmolded onto the leadframe 10, the bridges that attach the contacts 14 to one another may be "slugged out." The contacts 14 may be formed into any desired shape. FIG. 3 depicts an example embodiment of the leadframe assembly 48 after slug out and formation of the contacts 14. As shown, the lead portions 29 may be bent to a first angle (e.g., 90°) at a first bend point 66, to a second angle (e.g., 90°) at a second bend point 70, and to a third angle (e.g., 90°) at a third bend point 74. Thus, the lead portions 29 may be bent to include respective C-shaped portions that culminate in the respective mating portions 26 of the contacts 14. Consequently, the mating portions 26 of the contacts 14 may extend along a plane that is generally perpendicular to the plane along which the mounting portions 34 of the contacts 14 extend. In other words, the mating portions 26 of the contacts 14 may extend generally perpendicular to the mounting portions 34 of the contacts 14.

Figure 4:
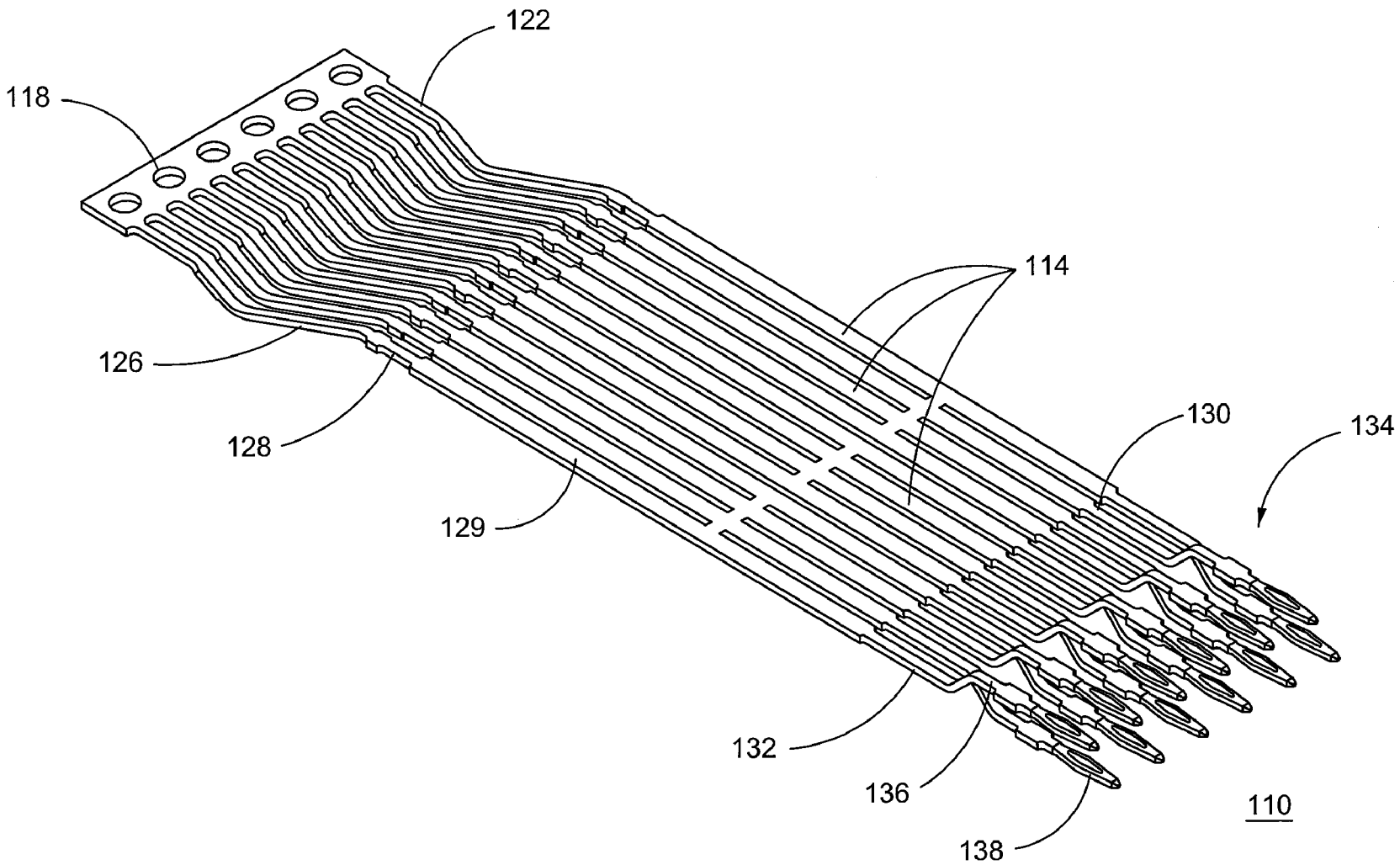
FIG. 4 depicts an isometric view of an embodiment of a second leadframe of electrical contacts as stamped and plated.

A second embodiment leadframe 110 of electrical contacts 114 may be stamped from a sheet of electrically conductive material, such as copper alloy, for example. FIG. 4, depicts the second leadframe 110 of electrical contacts 114 attached to one another and to a carrier frame 118. Each contact 114 may include a mating end 122, a mating portion 126, a first housing portion 128, a lead portion 129, a second housing portion 130, a third housing portion 132, a mounting portion 134, and a mounting end 136. The lead portions 129 of the contacts 114 may be attached to one another via "bridges" that remain after stamping. The mounting ends 136 of the contacts 114 may each include a tail 138. The contacts 114 may be selectively gold plated.

After the leadframe 110 has been stamped, a first leadframe housing 142 may be overmolded onto the first housing portions 128 of the contacts 114. A second leadframe housing 146 may be overmolded onto the second housing portions 130 of the contacts 114. Each leadframe housing may be made of a dielectric material, such as a plastic. Both the first leadframe housing 142 and the second leadframe housing 146 may be overmolded onto the leadframe 110 in a single molding process using well-known techniques.

Figure 5:
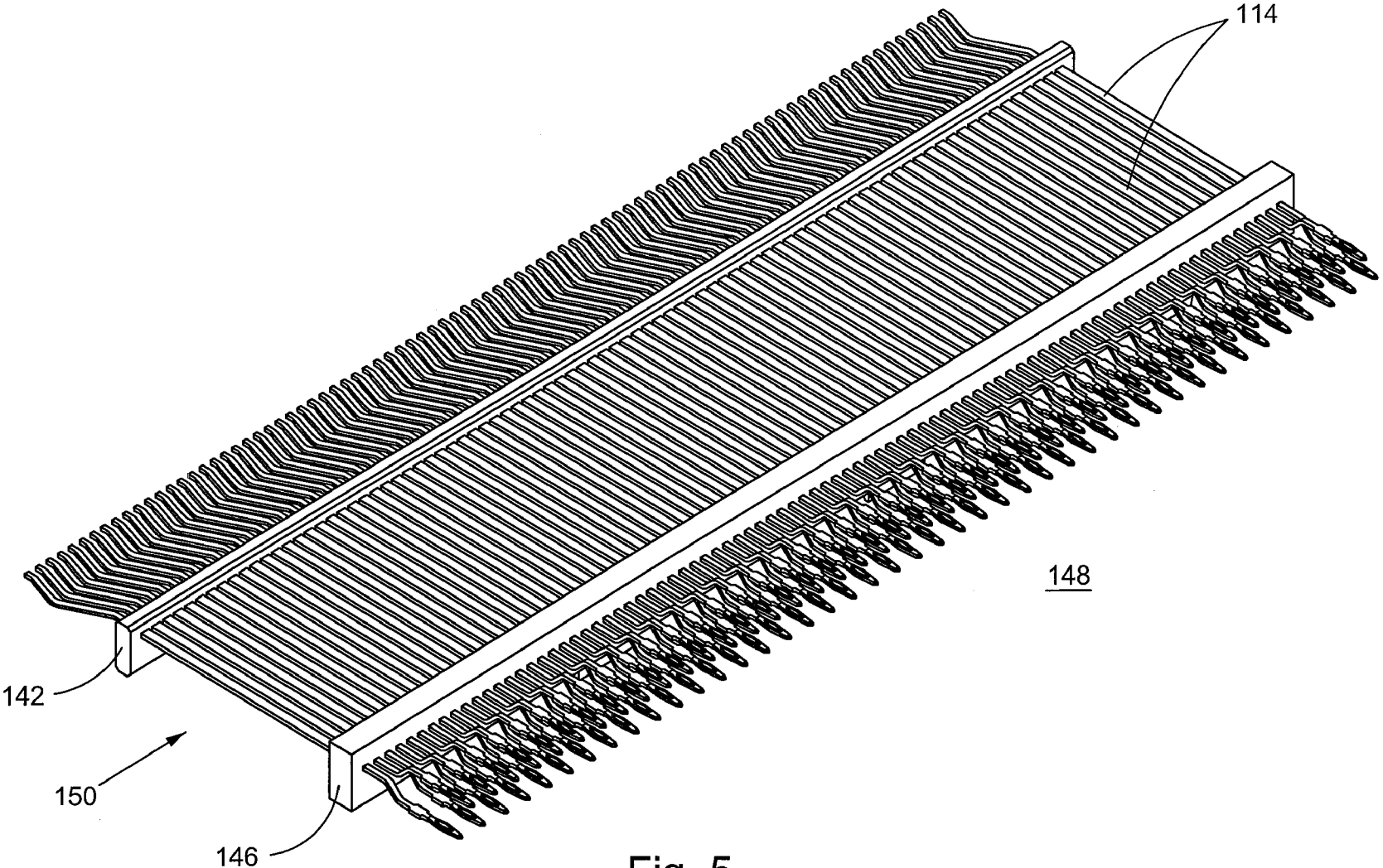
FIG. 5 depicts an isometric view of a second leadframe assembly after molding.

FIG. 5 depicts a second leadframe assembly 148 after the first leadframe housing 142 and the second leadframe housing 146 have been overmolded onto the electrical contacts 114, with the carrier frame 118 shown in FIG. 4 removed. As shown, a linear array 150, or "row," of electrical contacts 114 may extend through each of the first leadframe housing 142 and the second leadframe housing 146.

The second housing 146 may include one or more interlock members similar to those described in connection with FIG. 2. As described above in connection with FIG. 2, each interlock member may be a protrusion that extends from a face of the second leadframe housing 146, or a recess defined by the second leadframe housing 146. Each recess may be adapted to receive the complementary protrusion 58 extending from the second leadframe housing 46 of the first leadframe assembly 48 (see FIG. 3), and each protrusion may be adapted to be received in a complementary recess 62 defined by the second leadframe housing 46 of the first leadframe assembly 48. The interlock members will be described in more detail in connection with FIG. 8.

Figure 6:
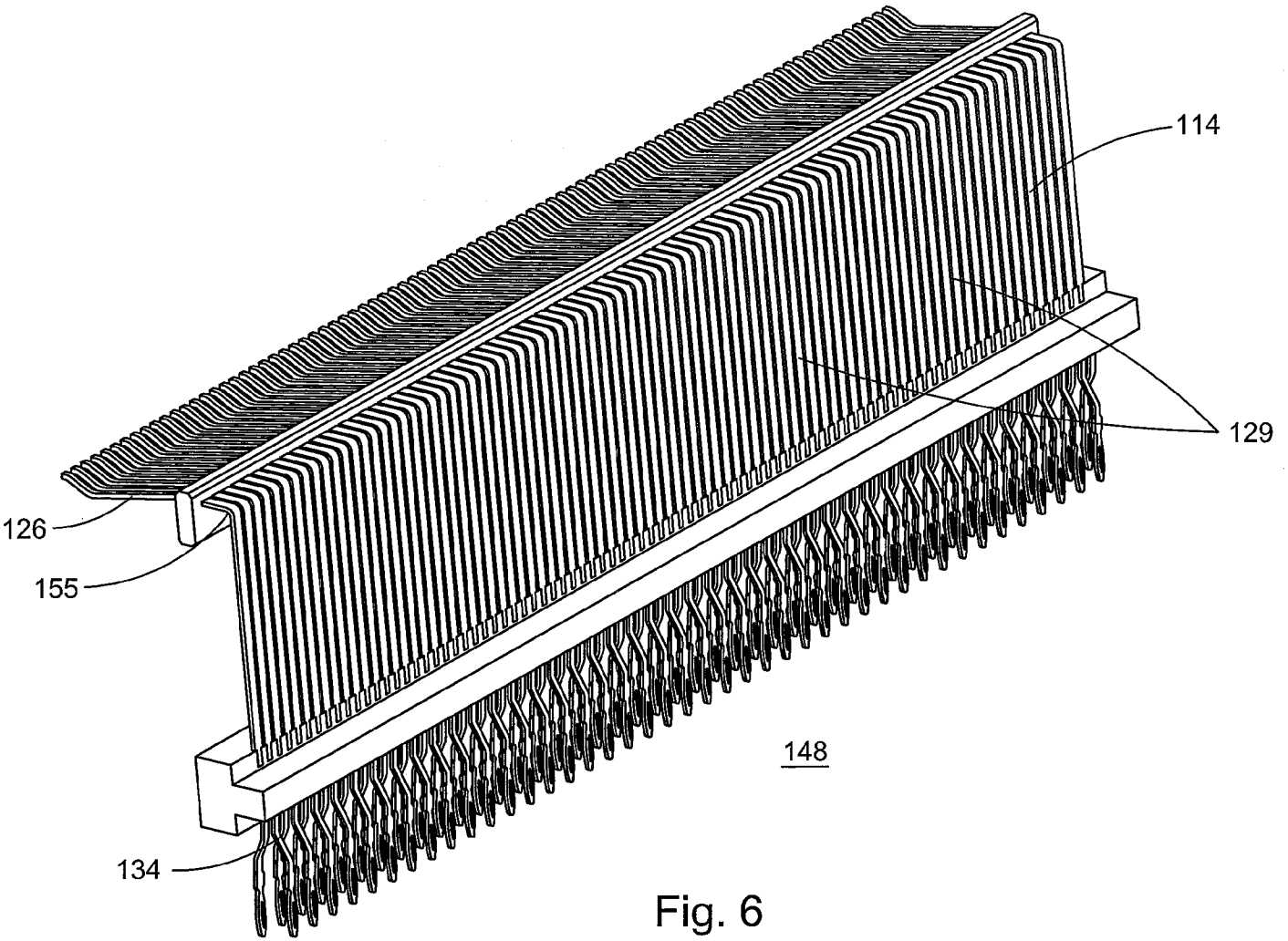
FIG. 6 depicts an isometric view of the leadframe assembly of FIG. 5 after forming and slug out.

After the first leadframe housing 142 and the second leadframe housing 146 are overmolded onto the leadframe 110, the bridges that attach the contacts 114 to one another may be "slugged out." The contacts 114 may be formed into any desired shape. FIG. 6 depicts an example embodiment of the leadframe assembly 148 after slug out and formation of the contacts 114. As shown, the lead portions 129 may be bent to an angle (e.g., 90°) at a bend point 155. Thus, the lead portions 129 may be bent to include respective L-shaped portions that culminate in the respective mating portions 126 of the contacts 114. Consequently, the mating portions 126 of the contacts 114 may extend along a plane that is generally perpendicular to the plane along which the mounting portions 134 of the contacts 114 extend. In other words, the mating portions 126 of the contacts 114 may extend generally perpendicular to the mounting portions 134 of the contacts 114.

Figure 7A:
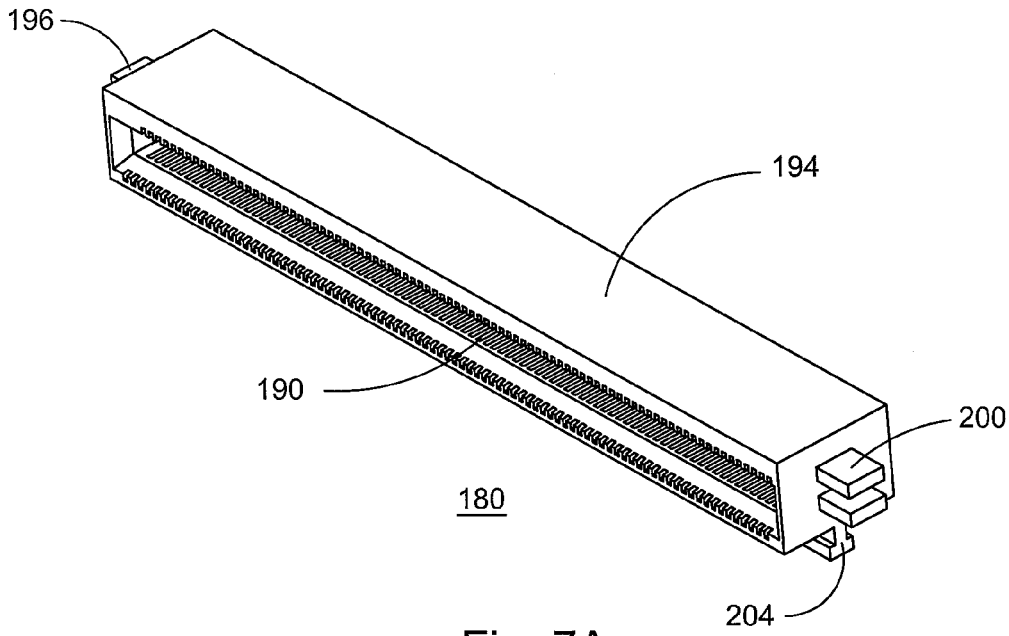
FIGS. 7A and 7B depict isometric views of an embodiment of an edge card housing.
Figure 7B:
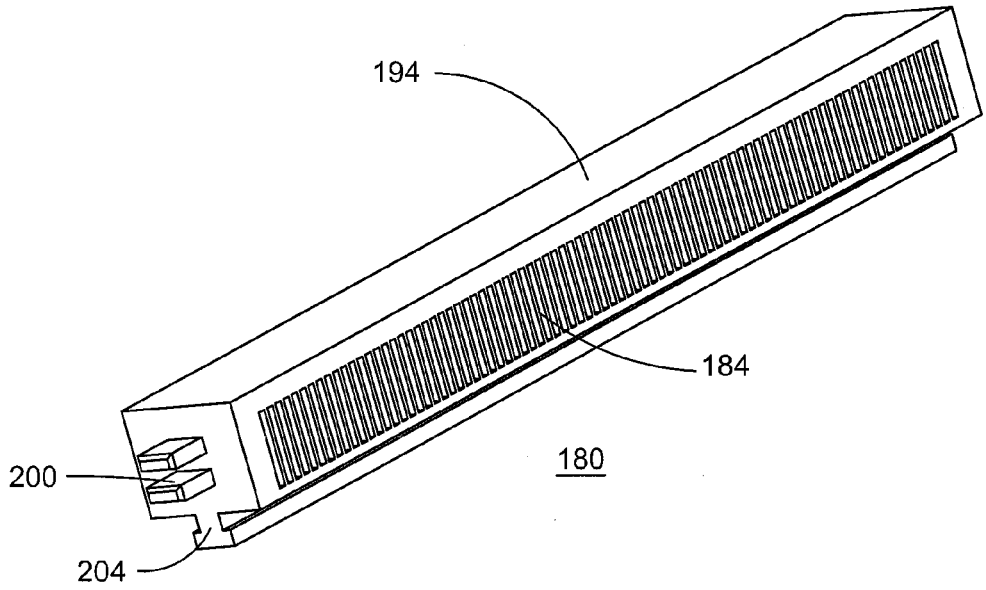

The mating portions 26 of the first leadframe assembly 48 and the mating portions 126 of the second leadframe assembly 148 may then be inserted into an edge card housing 180. FIGS. 7A and 7B depict an example embodiment of the edge card housing 180. The edge card housing 180 may be made of a dielectric material, such as a plastic. The edge card housing 180 may include a row of receptacles 184, a card slot 190, an edge card body 194, a first protrusion 196 extending from the left side of the edge card body 194, a second protrusion 200 extending from the right side of the edge card body 194, and a third protrusion 204 extending from the bottom of the edge card body 194. The first 196, second 200, and third 204 protrusions may be capable of being received by recesses formed in a connector housing. The housing will be explained in more detail in connection with FIGS. 14 and 15. In the embodiment shown in FIGS. 7A and 7B, the first protrusion 196 and the second protrusion 200 may each consist of two snap-fit members, and the third protrusion 204 may consist of a T-beam or dove tail. The edge card 180 is not limited to the disclosed embodiment and may incorporate different designs and structures.

Figure 8:
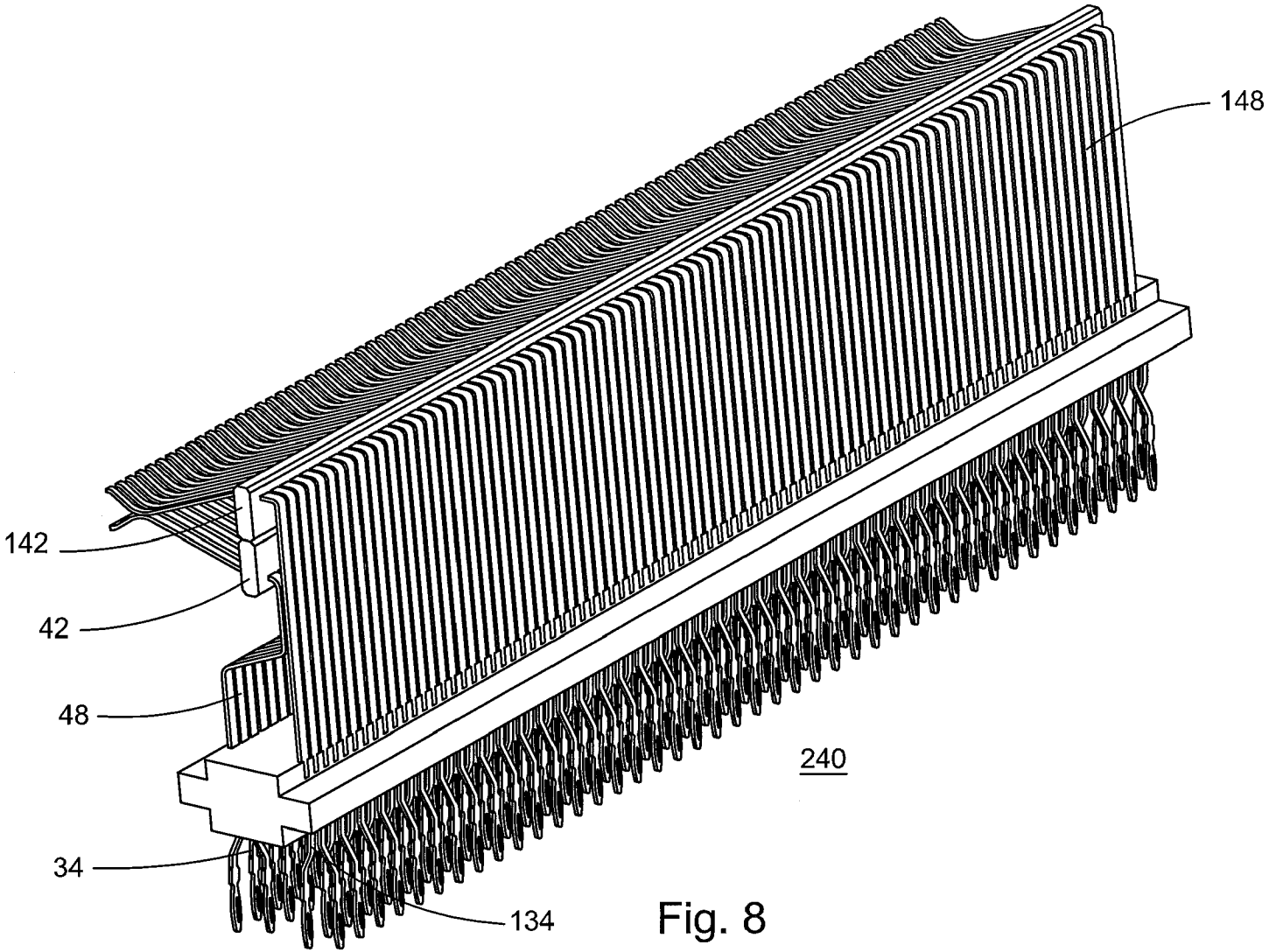
FIG. 8 depicts an isometric view of an embodiment of a complete assembly prior to insertion into the edge card housing.

FIG. 8 depicts an embodiment of the first leadframe assembly 48 and the second leadframe assembly 148 interlocked together creating a complete assembly 240. Each recess 62 (shown in FIG. 3) of the first leadframe assembly 48 may receive the respective protrusion from the second leadframe assembly 148 and each recess of the second leadframe assembly 148 may receive the respective protrusion 58 (shown in FIG. 3) from the first leadframe assembly 48. As shown, the first leadframe housing 142 of the second leadframe assembly 148 may rest on or connect to the first leadframe housing 42 of the first leadframe assembly 48. When the first leadframe assembly 48 and the second leadframe assembly 148 are combined, the mounting portions 34/134 of each leadframe assembly may be parallel.

The first leadframe assembly 48 may be inserted into the edge card housing 180. That is, the mating portions 26 of the contacts 14 of the first leadframe assembly 48 may be received into the row of receptacles 184 defined by the edge card housing 180.

Figure 9:
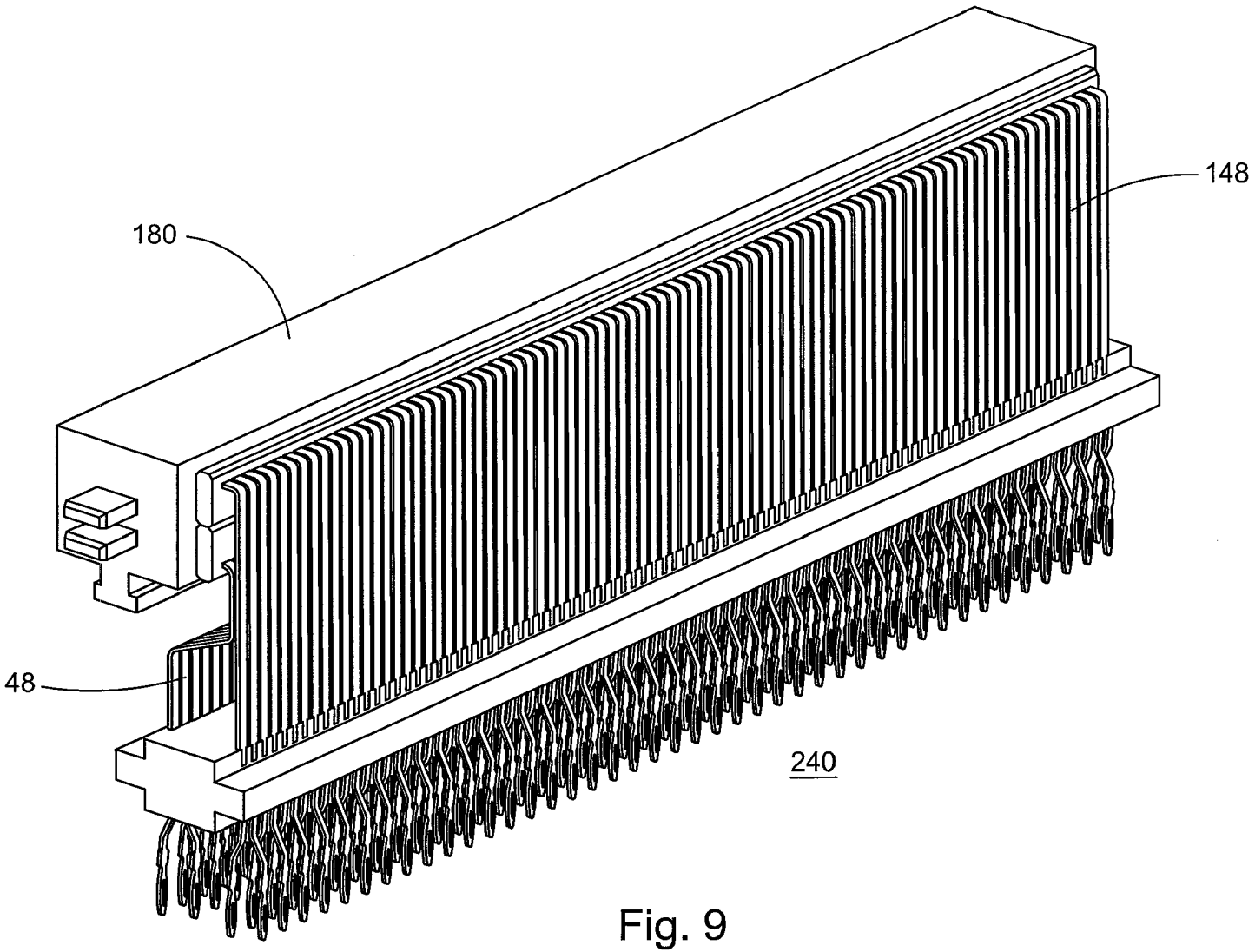
FIG. 9 depicts an isometric view of the complete assembly of FIG. 8 with the addition of the edge card housing of FIGS. 7A and 7B.

The second leadframe assembly 148 may be inserted into the edge card housing 180. That is, the mating portions 126 of the contacts 114 of the second leadframe assembly 148 may be received into the row of receptacles 184 defined by the edge card housing 180. FIG. 9 depicts an embodiment of the complete assembly 240 with both leadframe assemblies inserted into the edge card housing 180.

Figure 10:
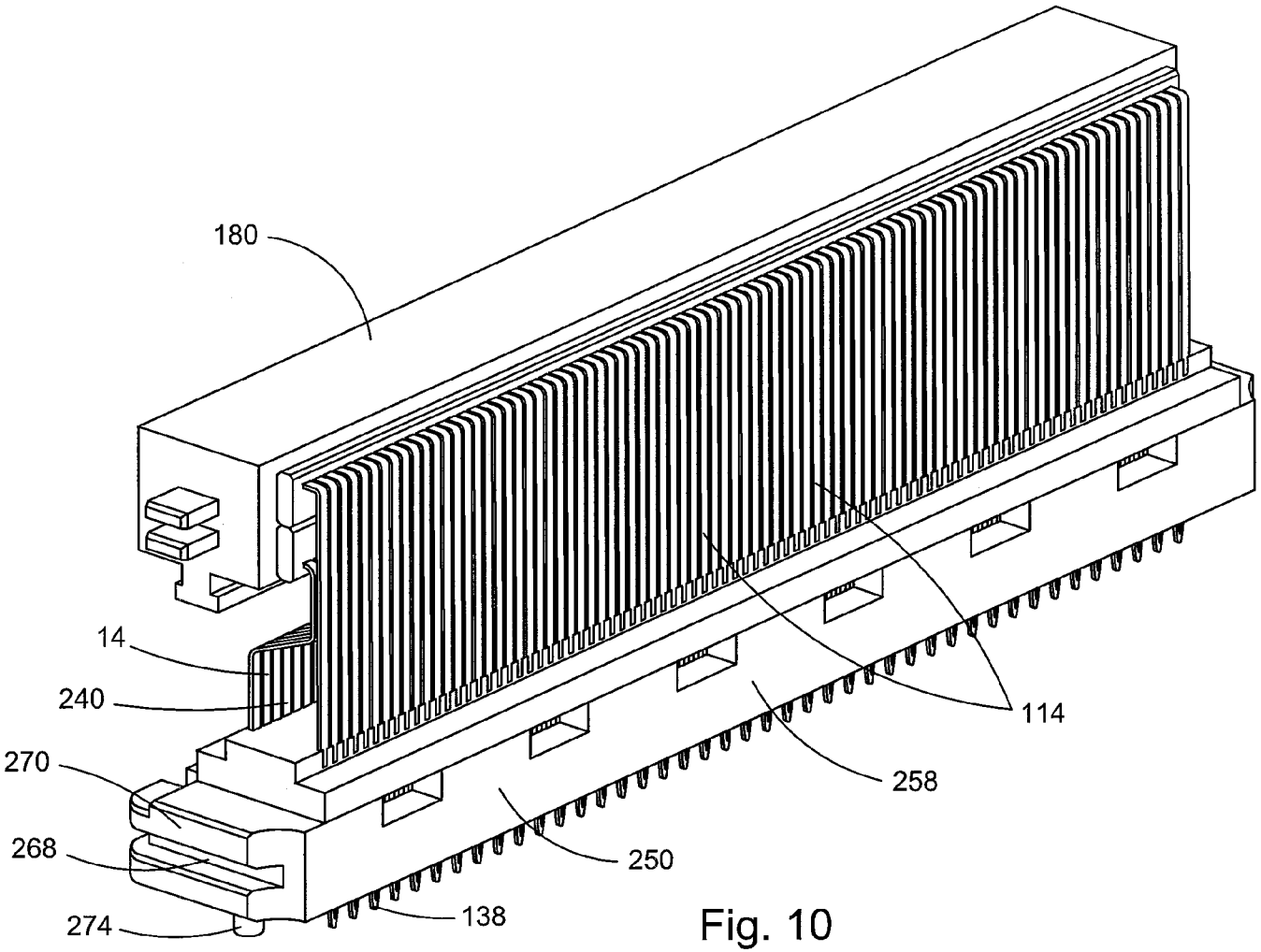
FIG. 10 depicts an isometric view of the complete assembly of FIG. 9 after the second overmold process.
Figure 11:
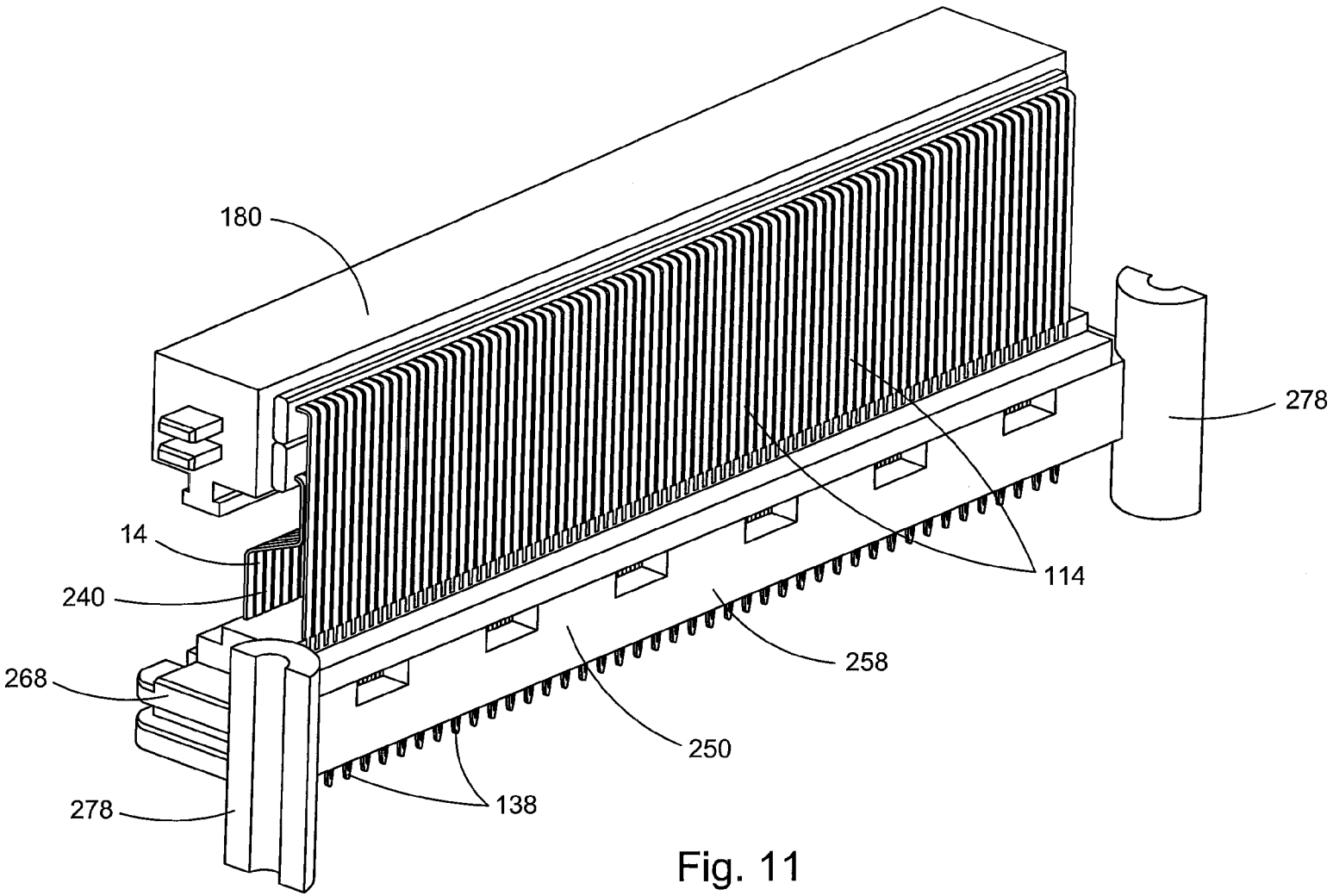
FIG. 11 depicts an isometric view of a second embodiment of the complete assembly of FIG. 9 after the second overmold process.
Figure 13:
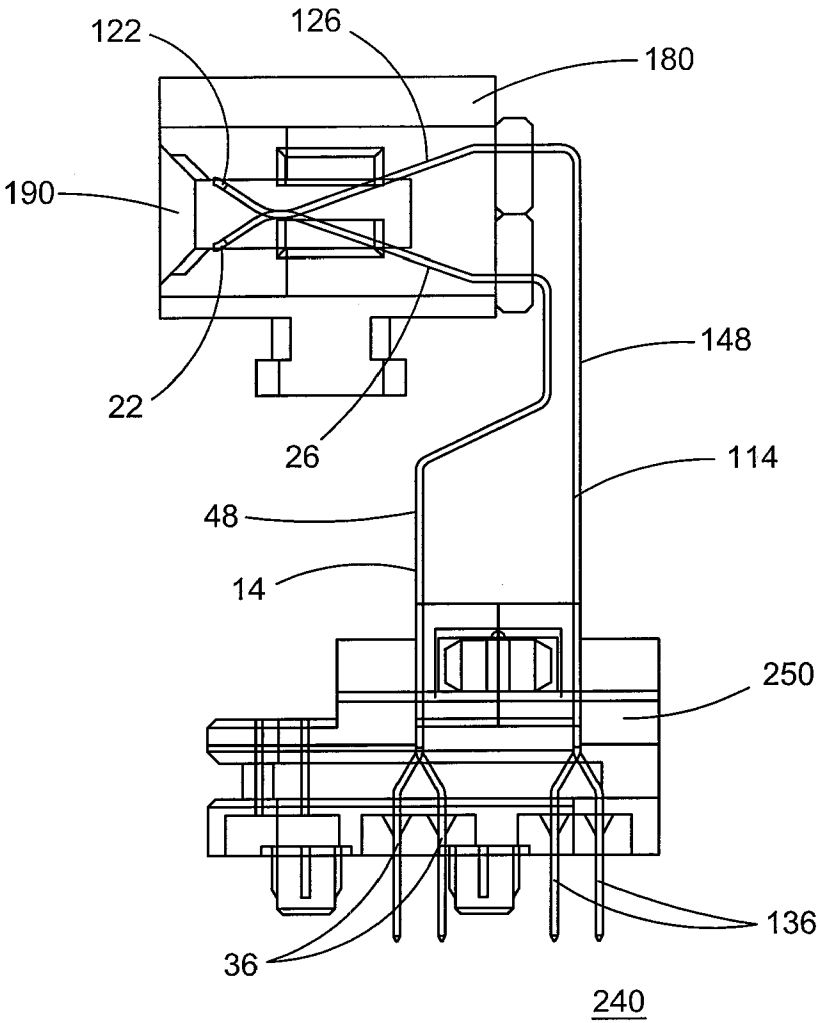
FIG. 13 depicts a cross-sectional view of the complete assembly of FIG. 10.

After the leadframe assemblies have been inserted into the edge card housing 180, a tail alignment housing 250 may be overmolded onto the third housing portions 32/132 of the contacts 14/114, using well-known injection molding techniques. The tail alignment housing 250 may be made of a dielectric material, such as a plastic. FIGS. 10 and 11 depict two embodiments of the complete assembly 240 after the second overmold process. As shown in both embodiments, the tail alignment housing 250 may extend up a portion of the mounting ends 36/136 (as shown in FIG. 13). Therefore, the tail alignment housing 250 may serve to control the position of the tails 38/138 of the mounting ends 36/136 (as shown in FIG. 13) and may provide a structure to transfer the forces for press fit of the connector to the PCB.

Figure 12A:
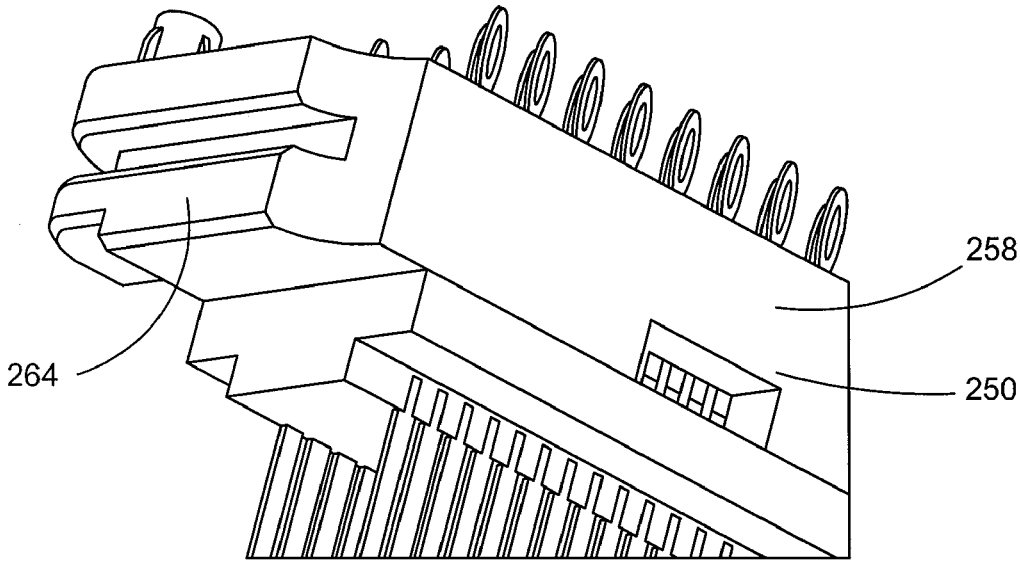
FIGS. 12A and 12B depict isometric views of the bottom of the complete assembly of FIG. 10.
Figure 12B:
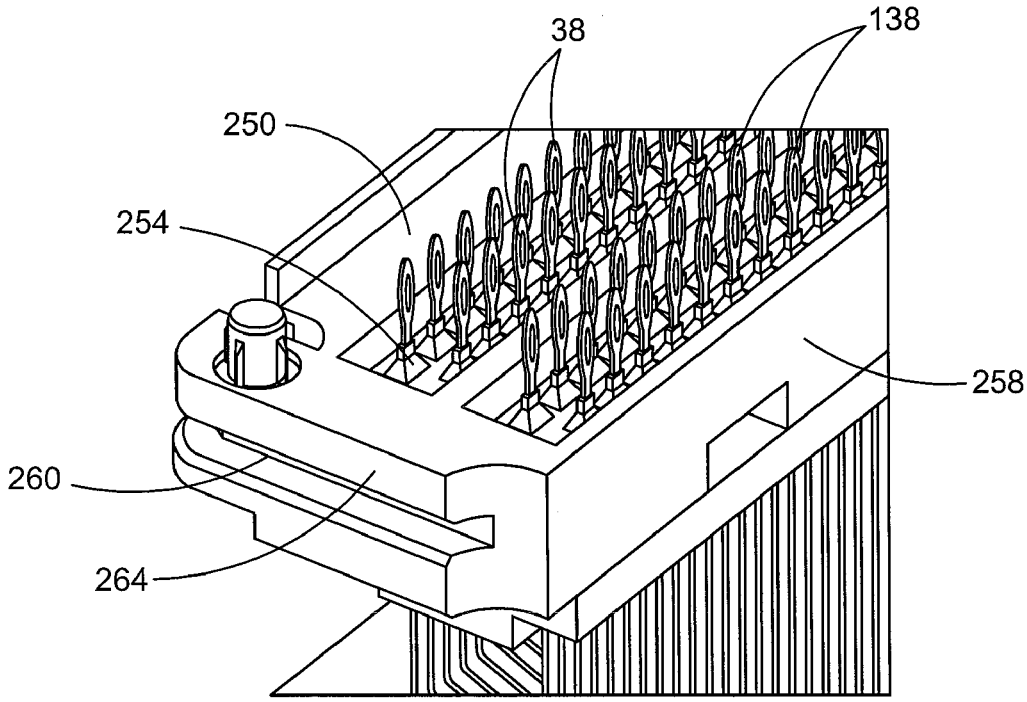

As shown in FIGS. 12A and 12B, the tail alignment housing may include a plurality of tail supports 254 extending from a body 258 of the tail alignment housing 250, that may help further control the position of the tails 38/138 and may provide further structure to the connector. The tail supports 254 may take the shape of pyramids, as for example depicted in FIG. 12B, but are not limited to such a design. For example, the supports 254 may also be cones, squares, rectangles, or any other designs capable of controlling the position of the tails 38/138. The tail alignment housing 250 may also have a first recess 260 formed in a left side 264 of the tail alignment housing 250 and a second recess 268 (as shown in FIG. 10) formed in a right side 270 of the tail alignment housing 250. The recess 260 and the recess 268 may be capable of receiving protrusions extending from the sides of the connector housing. The features described and depicted in FIGS. 12A and 12B may be incorporated into all embodiments of the tail alignment housing such as for example the tail alignment housings depicted in FIGS. 10 and 11.

As depicted in FIG. 10, the tail alignment housing 250 may further include press pegs 274 extending from the bottom of the tail alignment housing 250. The press pegs 274 may extend from a bottom portion of the tail alignment housing in such a way that the pegs do not interfere with the mounting ends 36/136 (shown in FIG. 13). The pegs 274 are not limited to the design described and may include other configurations.

As depicted in FIG. 11, the tail alignment housing 250 may further include a distant pillar 278 extending from either side of the tail alignment housing 250. Each pillar 278 may be a half-hollowed out cylinder. The pillars 278 may extend from the back corners of the tail alignment housing 250 in a longitudinal direction. The pillars 278 are not limited to the design described and may include other configurations.

FIG. 13 depicts a cross-sectional view of the complete assembly 240 after the second overmold process, showing how the contacts 14 of the first leadframe assembly 48 and the contacts 114 of the second leadframe assembly 148 may be oriented within the edge card 180, and the tail alignment housing 250. As shown, the mating portions 26 of the first leadframe assembly 48 may angle in a substantially upward direction within the edge card 180, and the mating portions 126 of the second leadframe assembly 148 may angle in a substantially downward direction within the edge card 180. Furthermore the mating ends 22 of the first leadframe assembly 48 may angle in a substantially downward direction, and the mating ends 122 of the second leadframe assembly 148 may angle in a substantially upward direction. Generally, the mating ends 22 and the mating ends 122 may extend toward the card slot 190 of the edge card 180. Also shown in FIG. 13, are the orientations of the mounting ends 36 of the first leadframe assembly 48 and the mounting portions 136 of the second leadframe assembly 148 within the tail alignment housing 250.

A connector housing may also be added to the complete assembly 240. The connector housing may be made of a dielectric material such as a plastic. In one embodiment, the connector housing may be separated into two pieces; a left connector housing 282 and a right connector housing 286. The left connector housing 282 may have a front wall portion 290 (shown in FIGS. 20 and 21) having a recess (not shown), a left side wall 296 having a recess (not shown), and a back wall portion 300 having a protrusion 308 extending from a right side 310 of the back wall portion 300. The right connector housing 286 may have a front wall portion 312 (shown in FIGS. 20 and 21) having a recess (not shown), a right side wall 318 having a recess 322, and a back wall portion 324 having a recess (not shown) formed in a left side of the back wall portion 324. The left side wall 296 of the left connector housing 282 may extend below the front wall portion 290 and the back wall portion 300 of the left connector housing 282. The right sidewall 318 of the right connector housing 286 may also extend below the front wall portion 312 and back wall portion 324 of the right connector housing 286. The extended portion of the left side wall 296 of the left connector housing 282 may have a protrusion (not shown) capable of being received by the recess 260 formed in the left side 264 of the tail alignment housing 250. The extended portion of the right side wall 318 of the right connector housing 286 may have a protrusion 342 capable of being received by the second recess 268 formed in the right side 270 of the tail alignment housing 250. The connector housing is not limited to such a design and may include other configurations capable of interlocking the housing to the edge card piece.

Figure 14:
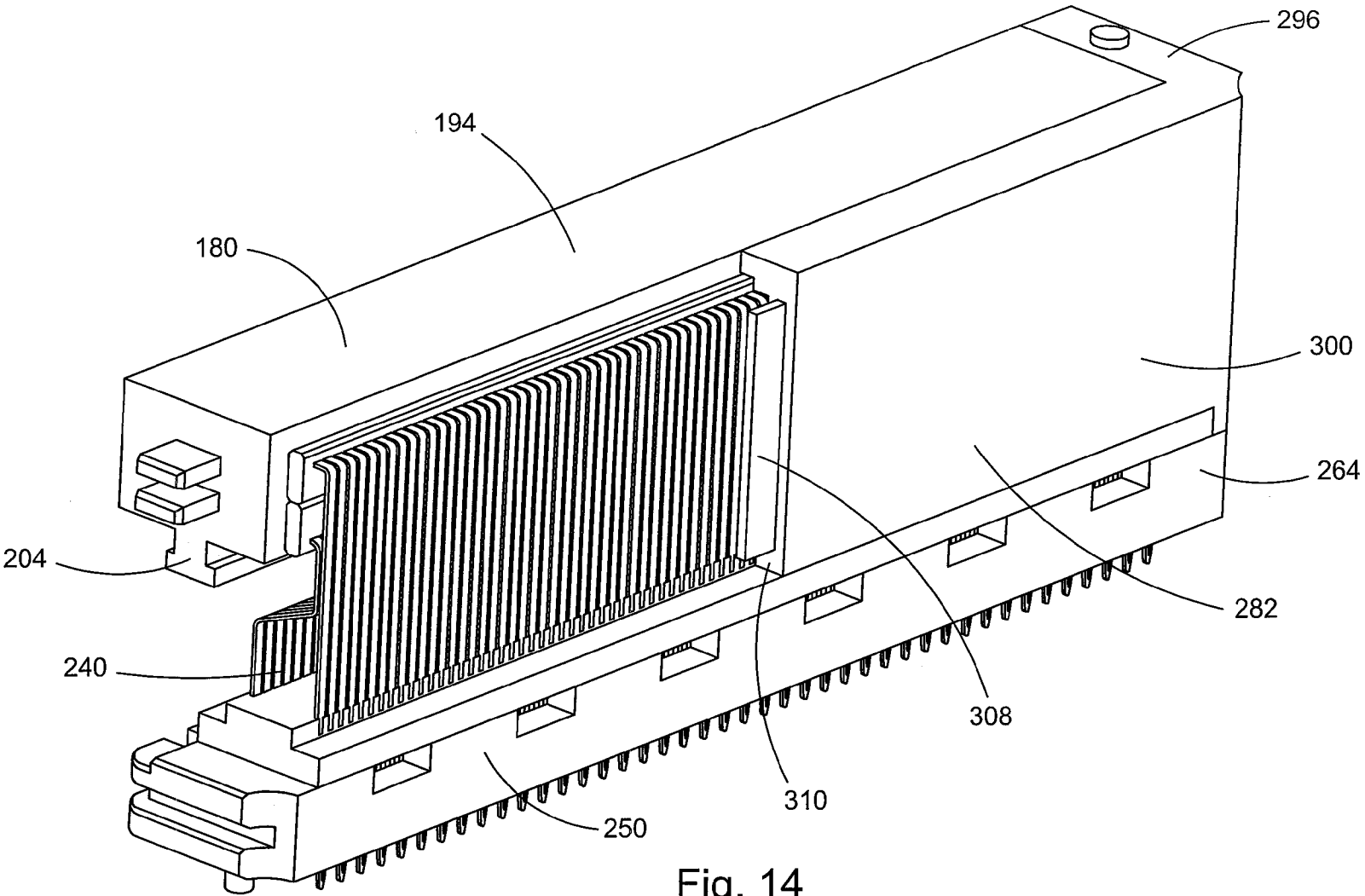
FIG. 14 depicts an isometric view of the complete assembly of FIG. 10 with a left connector housing added.

As shown in FIG. 14, the left connector housing 282 may be placed onto the complete assembly 240, interlocking the left connector housing 282 to the edge card piece 180. The first protrusion 196 (shown in FIG. 7A) extending from the left side of the edge card body 194 may interlock with the recess formed in the left side wall 296 of the left connector housing 282. A portion of the third protrusion 204 extending from the bottom of the edge card body 194 may interlock with the recess formed in the front wall portion 290 of the left connector housing 282. The protrusion extending from the extended portion of the left sidewall 296 may interlock with the recess 260 (shown in FIG. 12B) formed in the left side 264 of the tail alignment housing 250.

Figure 15:
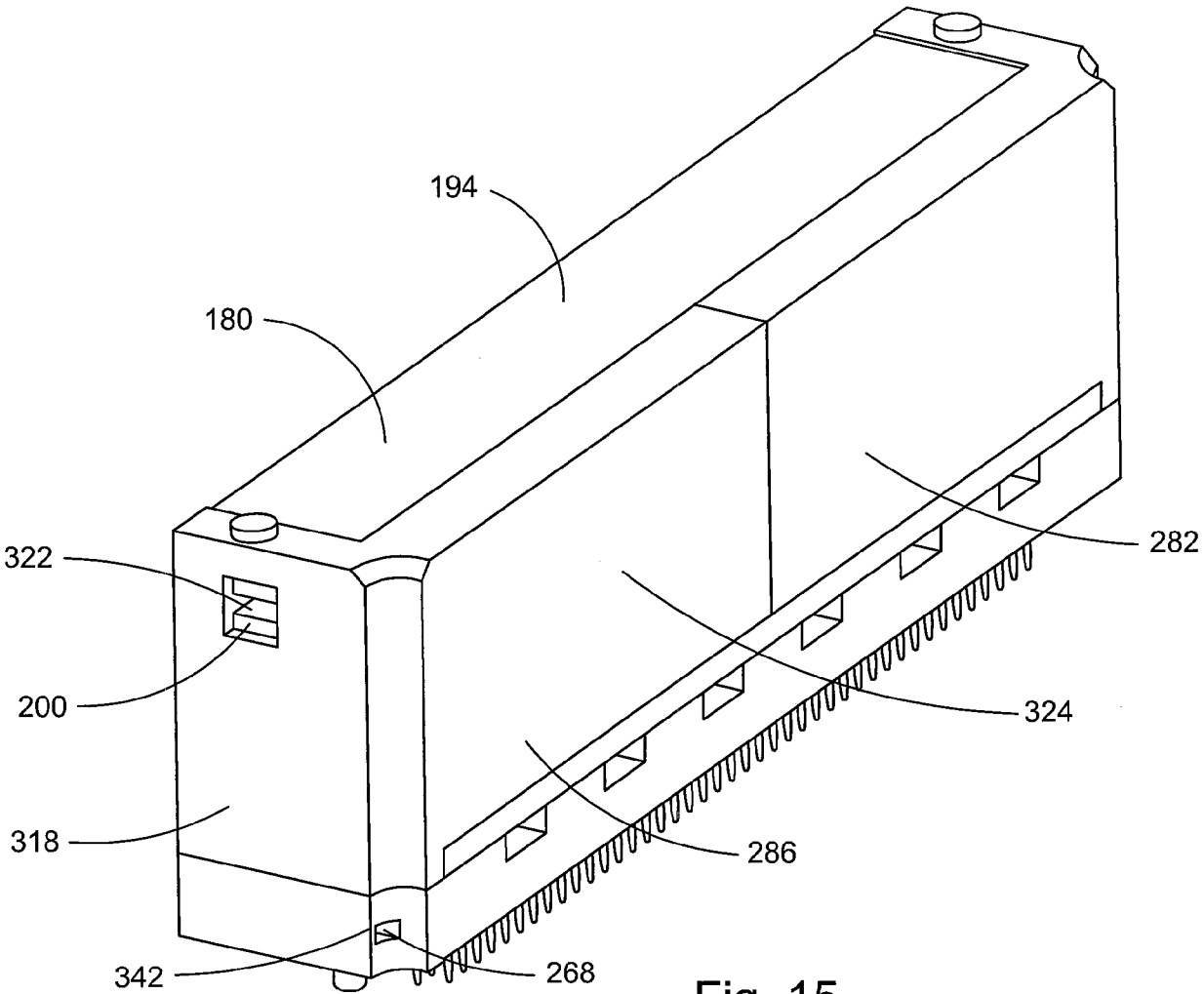
FIG. 15 depicts an isometric view of the complete assembly of FIG. 14 with a right connector housing added.
Figure 16:
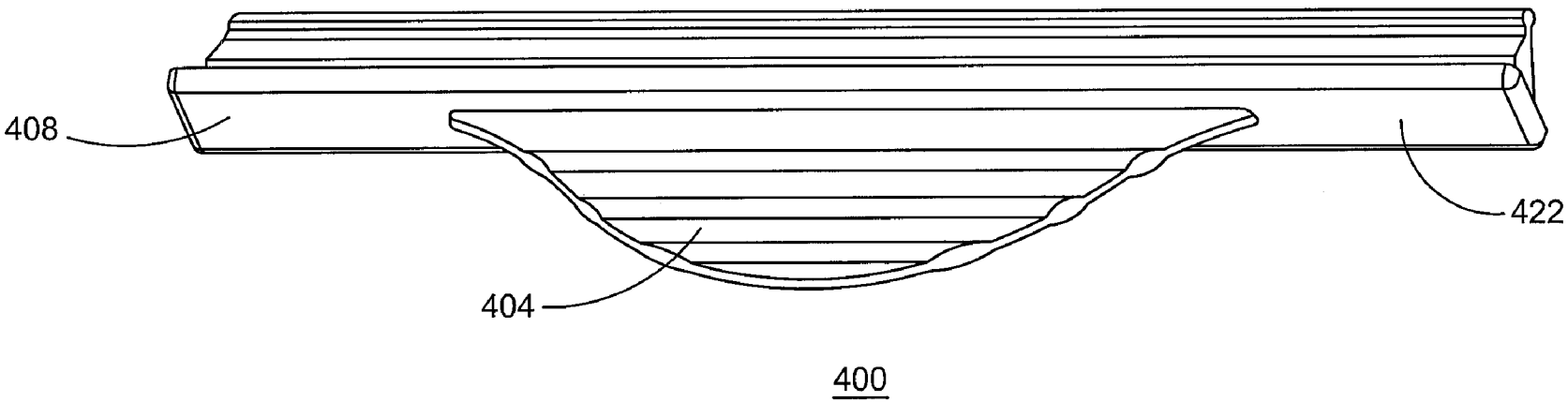
FIG. 16 depicts an isometric view of an embodiment of an insert.
Figure 18:
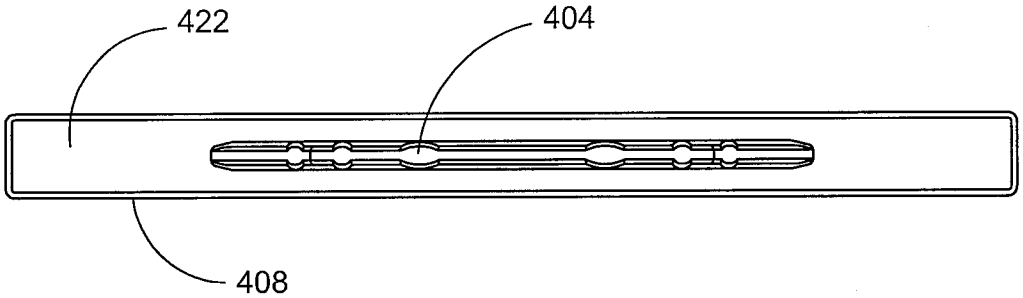
FIG. 18 is a front view of the insert of FIG. 16.

As shown in FIG. 15, the right connector housing 286 may be placed onto the complete assembly 240, interlocking the right connector housing 286 to the edge card piece 180. The second protrusion 200 extending from the right side of the edge card body 194 may interlock with the recess 322 formed in the right side wall 318 of the right connector housing 286. A portion of the third protrusion 204 (shown in FIG. 7A) extending from the bottom of the edge card body 194 may interlock with the recess formed in the front wall 312 of the right connector housing 286. The second protrusion 308 (shown in FIG. 14) extending from the right side 310 of the back wall portion 300 of the left connector housing 282 may interlock with the recess formed in the left side of the back wall portion 324 of the right connector housing 286. The protrusion 342 extending from the extended portion of the right sidewall 318 may interlock with the recess 268 formed in the right side 270 (shown in FIG. 10) of the tail alignment housing 250. Note that by having the right connector housing 286 and the left connector housing 282 interlock with the edge card housing 180, extra strength may be added to the edge card 180 to help withstand the force of "overmating."

Figure 17:
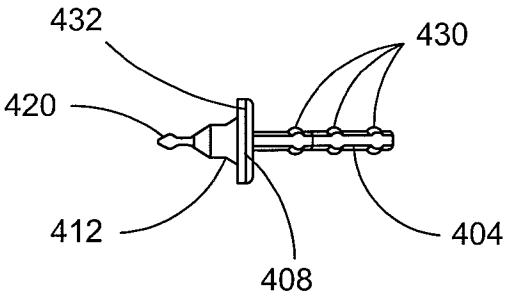
FIG. 17 is a side view of the insert of FIG. 16.
Figure 19:
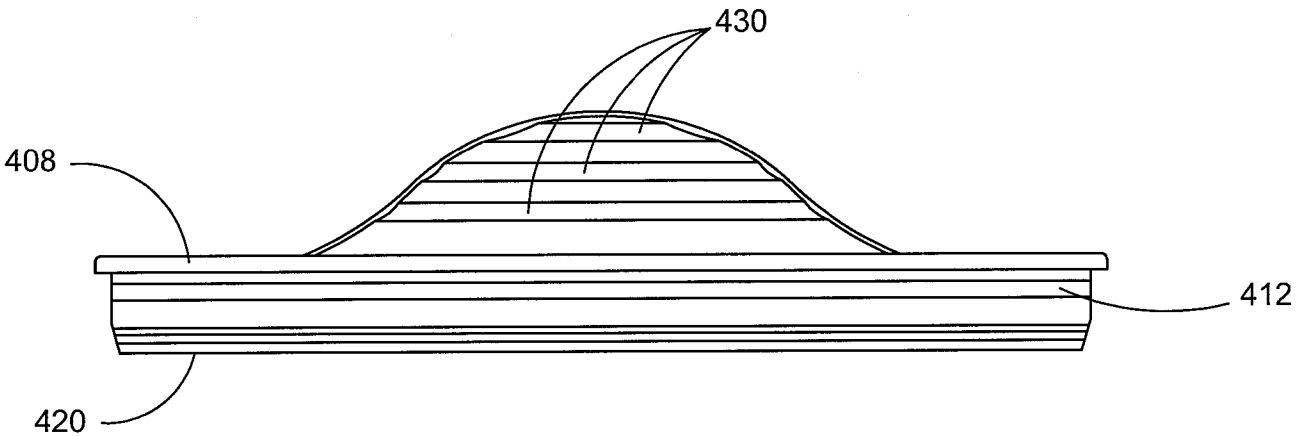
FIG. 19 is a top view of the insert of FIG. 16.

An insert 400 may be placed into the card slot 190 of the edge card housing 180. The insert 400 may be made of a dielectric material, such as a plastic. FIGS. 16-19 depict an example embodiment of the insert 400. As shown, the insert 400 may include a grip 404, a wall stop 408, a protective member 412 and a tip 420. The grip 404 may laterally extend from a back side 422 of the wall stop 408. The grip 404 may have a plurality of ribs 430 formed on the grip 404. The ribs may extend parallel to the wall stop 408. The protective member 412 may laterally extend from a front side 432 of the wall stop 408. The protective member 412 may decrease in size as it extends away from the wall stop 408. For example, as depicted in FIG. 17, the width of the protective member 412 may decrease to a point. The tip 420 may laterally extend from the protective member 412. The tip 420 and the protective member 412 may be inserted into the card slot 190 of the edge card 180 up until the wall stop 408 comes into contact with the edge card housing 180. The insert 400 may protect the contacts within the card slot 190. The insert 400 may double as a structural member so that the opening of the card slot 190 does not deform when pressing the connector onto the PCB. The insert 400 is not limited to the embodiment depicted and may include other designs.

Figure 20:
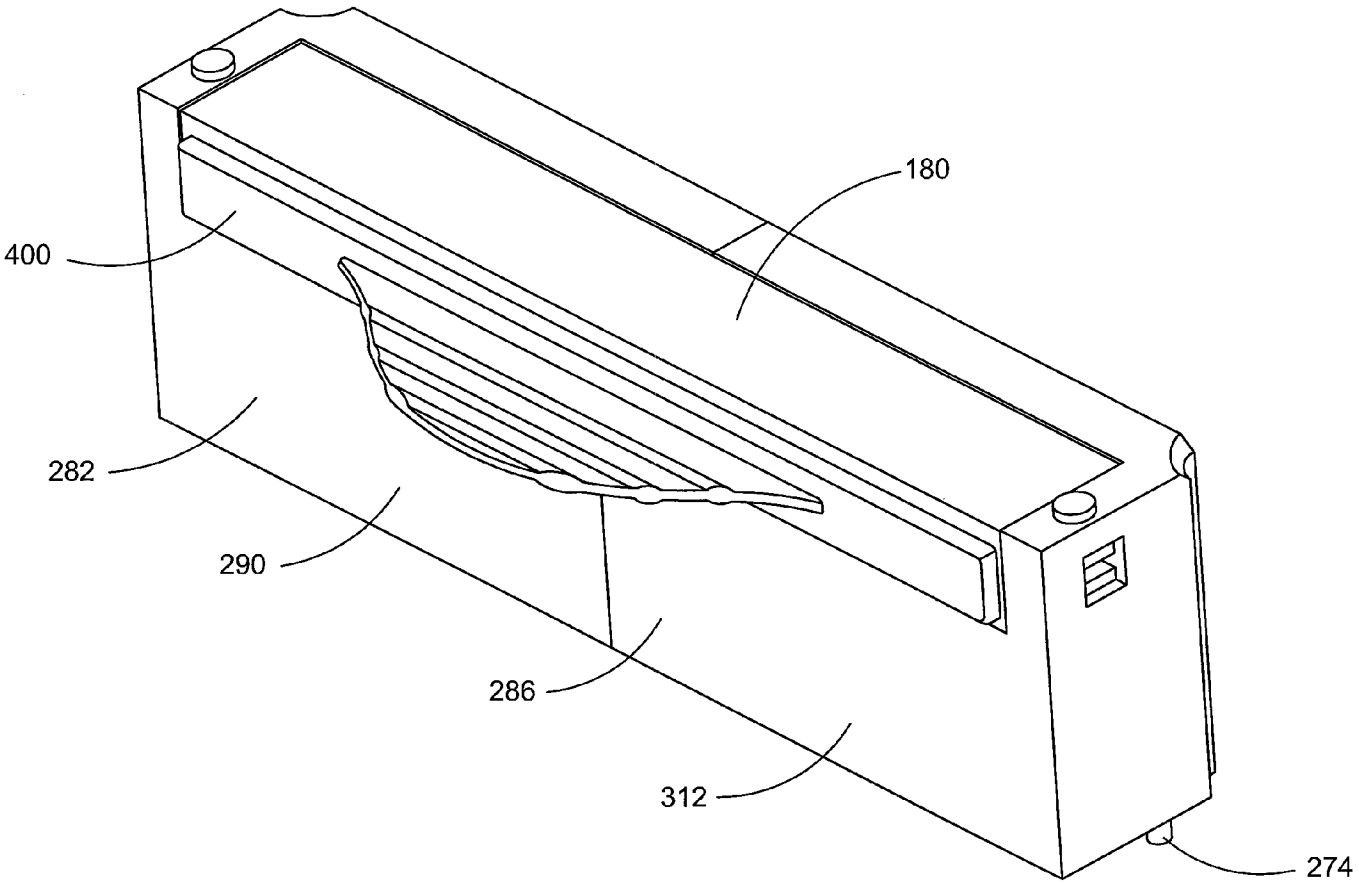
FIG. 20 depicts an isometric view of an embodiment of a complete connector with an insert added.
Figure 21:
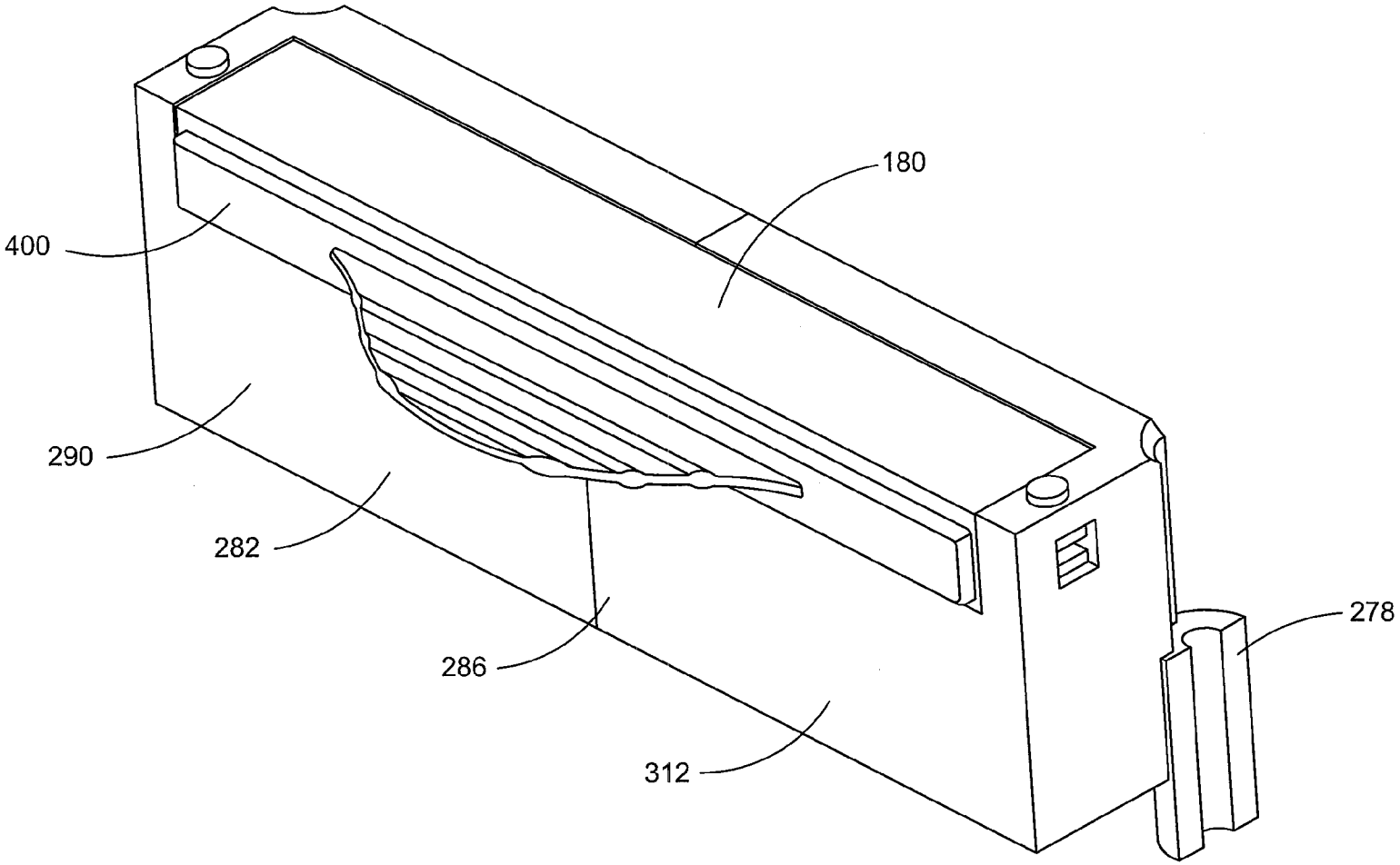
FIG. 21 depicts an isometric view of a second embodiment of a complete connector with an insert added.

The insert 400 may be disposed into any connector having a card slot 190. For example, FIGS. 20 and 21 depict the insert 400 placed in the card slot 190 of two embodiments of a completed connector.

What is claimed:

1. A connector comprising:

a first leadframe assembly having a plurality of electrical contacts, wherein each contact includes a mating portion;

a second leadframe assembly having a plurality of contacts, wherein each contact includes a mating portion;

an edge card having a card slot and a row of receptacles, wherein the mating portions of the first and second leadframe assemblies engage the receptacles and extend toward the card slot of the edge card; and an insert having a wall stop, and a protection member laterally extending from a front side of the wall stop, wherein the protection member extends into the card slot proximate the mating portions of the contacts and has a cross-sectional dimension that does not increase in a direction away from the wall stop, and the wall stop is configured to limit insertion of the insert into the card slot.

2. The connector of claim 1, wherein the front side of the wall stop abuts a front side of the edge card housing when the insert is positioned within the card slot.

3. The connector of claim 1, wherein the protection member decreases in size as the protection member extends from the wall stop.

4. The connector of claim 1, wherein the insert includes a tip laterally extending from the protection member.

5. The connector of claim 1, wherein the insert is made of plastic.

6. The connector of claim 1, wherein the connector is an AMC B+ connector.

7. The connector of claim 1, wherein the mating portions of the first and second leadframe assemblies extend toward each other.

8. The connector of claim 1, wherein the insert further comprises a tip extending from the protection member.

9. The connector of claim 1, wherein the insert includes a grip laterally extending from a back side of the wall stop.

10. The connector of claim 9, wherein the grip includes ribs extending parallel to the wall stop.

11. A connector comprising:

an edge card having a body that defines a laterally extending card slot in a front side thereof; and an insert having a vertically extending wall stop and a protection member extending laterally from a front side of the wall stop, wherein the protection member is disposed within the card slot defined by the edge card body, and the protection member defines a dimension that extends parallel to the wall stop, and the dimension does not increase in a direction away from the wall stop such that the protection member prevents deformation of the card slot and the front side of the wall stop is configured to abut the front side of the edge card body.

12. The connector of claim 11, wherein the front side of the wall stop abuts a front side of the edge card housing when the insert is positioned within the card slot.

13. The connector of claim 11, wherein the protection member decreases in size as the protection member extends away from the wall stop.

14. The connector of claim 11, wherein the insert includes a tip laterally extending from the protection member.

15. The connector of claim 11, wherein the insert is made of plastic.

16. The connector of claim 9, wherein the connector is an AMC connector.

17. The connector of claim 11, wherein the insert extends along an entirety of the slot along the front surface of the body.

18. The insert of claim 11, wherein the insert further comprises a tip extending form the protection member.

19. The connector of claim 11, wherein the insert includes a grip laterally extending from a back side of the wall stop.

20. The connector of claim 19, wherein the grip includes ribs extending parallel to the wall stop.

21. An insert for a connector having an edge card, the insert comprising:

a wall stop having a front side and a back side;

a grip laterally extending from the back side of the wall stop; and a protection member extending from the front side of the wall stop, wherein (i) the protection member has a cross sectional dimension that does not increase in a direction away from the wall stop, and is adapted to be inserted into an open end of a card slot of an edge card, and (ii) the wall stop is disposed exterior to the open end of the card slot and is configured to limit the insertion of the protection member into the card slot.

22. The insert of claim 21, wherein the protection member decreases in size as the protection member extends from the wall stop.

23. The insert of claim 21, wherein the insert is made of plastic.

24. The insert of claim 21, wherein the grip includes ribs extending parallel to the wall stop.

25. The insert of claim 21, further including a tip laterally extending from the protection member.

26. The insert of claim 21, wherein the insert further comprises a tip extending from the protection member.

27. The connector of claim 26, wherein the insert further comprises a tip extending from the protection member.

28. The connector of claim 21, wherein the edge card defines an edge card body having a front surface that defines the open end of the card slot, and the wall stop is disposed proximate the front surface of the edge card body.

29. The connector of claim 28, wherein the wall stop is configured to abut the front surface of the edge card body.

30. A connector comprising:

a first leadframe assembly having a plurality of electrical contacts, wherein each contact includes a mating portion;

a second leadframe assembly having a plurality of contacts, wherein each contact includes a mating portion;

an edge card having an elongate card slot extending in a direction of elongation, and a row of receptacles, wherein the mating portions of the first and second leadframe assemblies engage the receptacles and extend toward the card slot of the edge card; and an insert having a wall stop, and a protection member laterally extending from a front side of the wall stop, wherein the protection member has a cross sectional dimension that does not increase in a direction away from the wall stop, and the protection member extends into the card slot proximate the mating portions of the contacts, and the protection member extends along a substantial entirety of the elongate card slot in the direction of elongation.

* * * * *